US007628195B2

(12) United States Patent
Drew

(10) Patent No.: US 7,628,195 B2
(45) Date of Patent: Dec. 8, 2009

(54) NONRETRACTABLE COVERING FOR ARCHITECTURAL OPENINGS

(75) Inventor: Terrence M. Drew, Superior, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 41 days.

(21) Appl. No.: 11/673,200

(22) Filed: Feb. 9, 2007

(65) Prior Publication Data

US 2007/0187045 A1 Aug. 16, 2007

Related U.S. Application Data

(60) Provisional application No. 60/774,048, filed on Feb. 16, 2006.

(51) Int. Cl.
*E06B 9/36* (2006.01)
*E06B 7/08* (2006.01)

(52) U.S. Cl. ..... 160/84.05; 160/176.1 R; 49/74.1; 49/403

(58) Field of Classification Search ..... 160/121.1, 160/168.1 R, 174 R, 175, 176.1 R, 84.05, 160/89; 49/403, 61–65, 67, 74.1, 80.1, 87.1; 188/78, 196 V, 265
See application file for complete search history.

(56) References Cited

U.S. PATENT DOCUMENTS

| | | | | | |
|---|---|---|---|---|---|
| 562,380 | A * | 6/1896 | Durphy | 248/265 |
| 4,479,397 | A * | 10/1984 | Jelinek et al. | 74/89.37 |
| 5,313,999 | A | 5/1994 | Colson et al. | |
| 5,339,591 | A * | 8/1994 | Underdahl | 52/473 |
| 5,419,385 | A * | 5/1995 | Vogel et al. | 160/121.1 |
| 5,595,231 | A * | 1/1997 | Marocco | 160/168.1 R |
| 5,664,613 | A * | 9/1997 | Jelic | 160/84.05 |
| 5,887,386 | A * | 3/1999 | Alexanian et al. | 49/403 |
| 6,655,091 | B1 * | 12/2003 | Iwasaki | 49/403 |
| 7,168,475 | B2 * | 1/2007 | Colson et al. | 160/168.1 R |
| 2004/0045220 | A1 * | 3/2004 | Fraser et al. | 49/74.1 |

* cited by examiner

*Primary Examiner*—Katherine W. Mitchell
*Assistant Examiner*—Jeremy C Ramsey
(74) *Attorney, Agent, or Firm*—Dorsey & Whitney LLP

(57) ABSTRACT

A nonretractable covering for architectural openings such as doors, windows, archways, or the like includes a covering fabric like material having pivotal vanes with the fabric like material being extended between upper and lower tilt bars with one of the upper lower tilt bars being an active tilt bar and the other a passive tilt bar which moves in response to the active tilt bar. Movement of the active tilt bar between opened and closed positions pivots the vanes between opened and closed positions while the fabric material remains extended across the architectural opening.

7 Claims, 14 Drawing Sheets

NONRETRACTABLE COVERING FOR ARCHITECTURAL OPENINGS

CROSS REFERENCE TO RELATED APPLICATION

This application claims priority to U.S. Provisional Application No. 60/774,048 filed Feb. 16, 2006 and is hereby incorporated by reference as if fully disclosed herein.

BACKGROUND OF THE INVENTION a. Field of the Invention

The present invention relates generally to coverings for architectural openings and more specifically to a nonretractable covering that does not extend and retract across the architectural opening, but does open and close by pivotal movement of slats used in the covering. The slats are pivoted about longitudinal axis between an open position wherein a space is defined between the slats to permit vision through the covering and a closed position wherein the slats lie substantially in a common plane and block vision through the covering.

b. Description of the Relevant Art

Coverings for architectural openings have assumed numerous forms over many years with early forms of such coverings simply employing draped fabric across an architectural opening such as a doorway, window, archway or the like. Retractable coverings in the form of curtains, draperies or the like have also been a popular form of covering wherein the fabric used in the covering is typically pleated and suspended from a control system for movement of the fabric between an extended position across the architectural opening and retracted position adjacent one or more sides of the opening.

More recently, retractable coverings of the venetian blind type have been very popular wherein the blind includes a plurality of horizontally disposed slats that are suspended on cord tapes or ladders and movable, not only between an extended and retracted position relative to the architectural opening, but are also movable between open and closed positions by pivoting the slats about longitudinal axis so that in the open position, a space is defined between the slats through which vision is permitted and in the closed position, the slats are aligned in a common plane blocking the passage of vision through the blind.

Vertical blinds are also very popular. Vertical blinds are similar to a Venetian blind except the vanes or slats used in the blind are vertically oriented rather than horizontally oriented. The vanes or slats operate in the same manner so that the blind can be extended or retracted across the architectural opening or the slats in the blind can be tilted about their longitudinally vertical axis between open and closed positions.

More recently, cellular shades have become popular wherein the fabric material used in the shade is comprised of a plurality of collapsible cells with the fabric being extendable across the architectural opening or retracted by collapsing the cells adjacent one or more sides of the architectural opening. The fabric can also be wrapped around a roller.

In some instances, cellular shades also include pivotal slats similar to a Venetian blind wherein the slats are supported along longitudinal edges by front and rear transparent or translucent fabrics such as sheer and the front and rear sheer fabric supports are movable in opposite vertical directions to pivot the slats between open and closed positions. This type of cellular covering is also retractable in nature and can be rolled about a roller at one edge of the architectural opening.

SUMMARY OF THE INVENTION

The present invention relates to a covering for an architectural opening that is not retractable, but includes a plurality of pivotal slats so that the covering can be moved between open and closed positions wherein vision is permitted between the slats or blocked respectively. The covering is not movable between extended and retracted positions across the opening but rather remains extended across the opening. The covering includes a flexible fabric that extends across the architectural opening and has mounting brackets at each side of the opening for supporting either an active or a passive tilt bar. The fabric for the covering is anchored at opposite ends to the active and passive tilt bars and the active tilt bar is mounted for pivotal movement so as to tilt the slats of the covering between open and closed positions. A variable braking system is incorporated into the mounting brackets for the active tilt bar to vary the amount of force necessary to tilt the bar and thus move the slats between open and closed positions and for retaining the slats in any desired position. The passive tilt bar is mounted for free pivotal movement as well as sliding movement in the direction of the fabric so as to follow movement of the active tilt bar. A control wand may also be provided to facilitate movement of the active tilt bar between open and closed positions in operation of the covering.

Other aspects, features and details of the present invention can be more completely understood by reference to the following detailed description of a preferred embodiment, taken in conjunction with the drawings and from the appended claims.

DESCRIPTION OF THE PREFERRED EMBODIMENT

Figure 5:
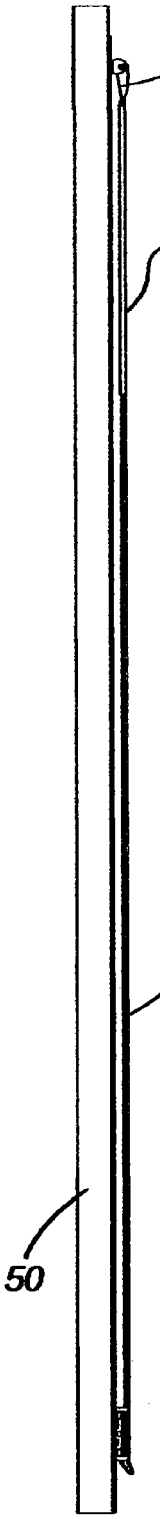
FIG. 5 is a left side elevation of the covering as shown in FIG. 4.

The nonretractable covering 30 of the present invention is designed to be retained in an architectural opening such as a door, window, archway or the like in an extended position. For purposes of the present disclosure, the covering is shown in FIGS. 1-5 mounted across a glass panel 32 in the door of a building structure. Further, while the covering is shown as including a particular fabric material 34, it will be appreciated from the disclosure hereafter that numerous fabrics or blinds could be used. The disclosed fabric is comprised of a pair of spaced vertically extending transparent or translucent sheets 36 of flexible material such as sheer to which a plurality of horizontally disposed flexible fabric vanes or slats 38 are connected. The vanes or slats have longitudinal edges secured to the sheets 36 at vertically spaced locations. The fabric illustrated for purposes of the disclosure of the present invention is described in detail in U.S. Pat. No. 5,313,999, which is of common ownership with the present application and the disclosure of which is hereby incorporated by reference. While the fabric material can be used in a retractable covering as described in the aforenoted patent, for the purposes of the present invention, the fabric remains in an extended condition as illustrated in FIGS. 4-5 even though the slats or vanes 38 in the material can be pivoted about longitudinal horizontal axis as will be described hereafter.

With reference first to FIGS. 1-5, the covering 30 can be seen to include the aforedescribed fabric, an active pivotal tilt bar 40 connected to the top edge of the fabric, a passive pivotal tilt bar 42 connected to the bottom edge of the fabric, a pair of active mounting brackets 44 and 46 secured to the active tilt bar and pair of passive mounting brackets 48 secured to the passive tilt bar. The mounting brackets are all secured to a mounting surface which for purposes of the present disclosure is a door 50 of a building structure.

Figure 1:
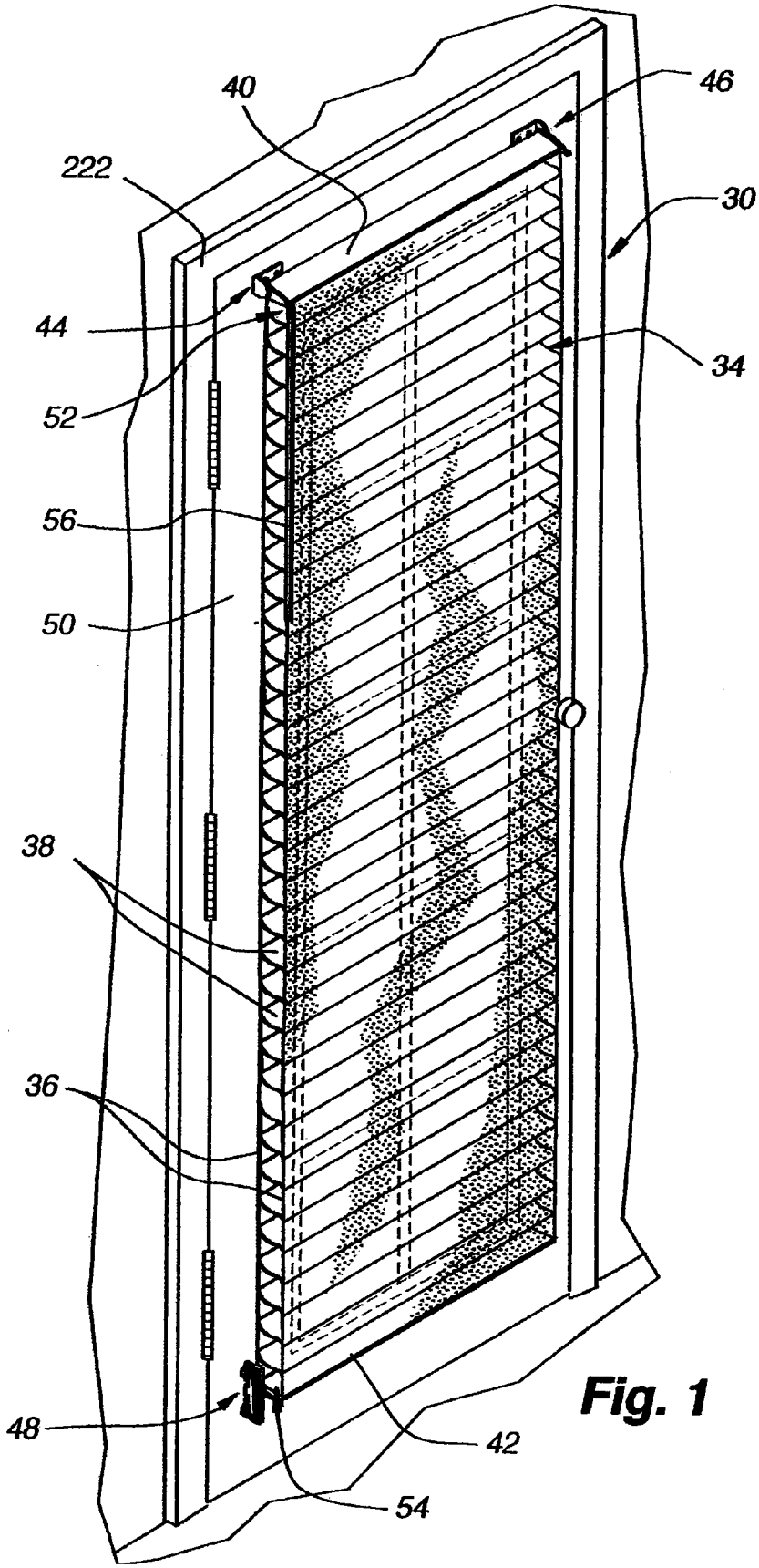
FIG. 1 is an isometric of the covering of the present invention in an open position mounted on a door in an architectural opening.
Figure 3:
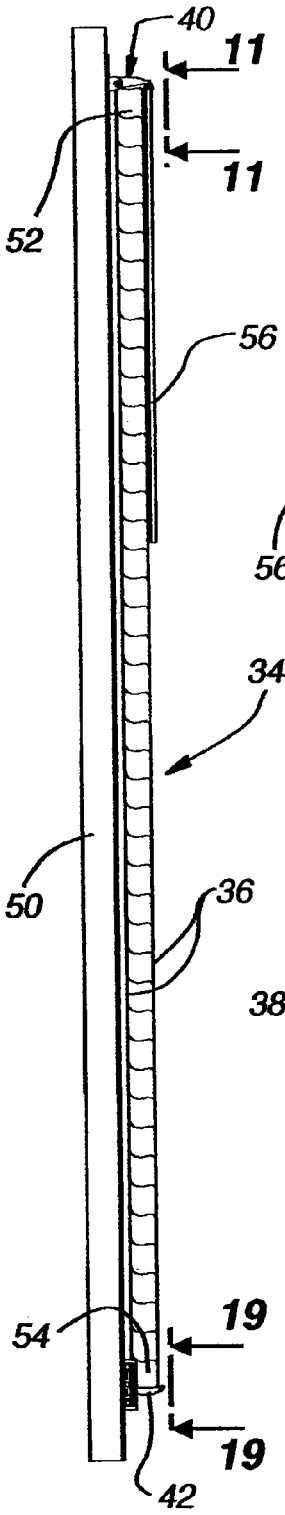
FIG. 3 is a left side elevation of the covering as shown in FIG. 2.
Figure 2:
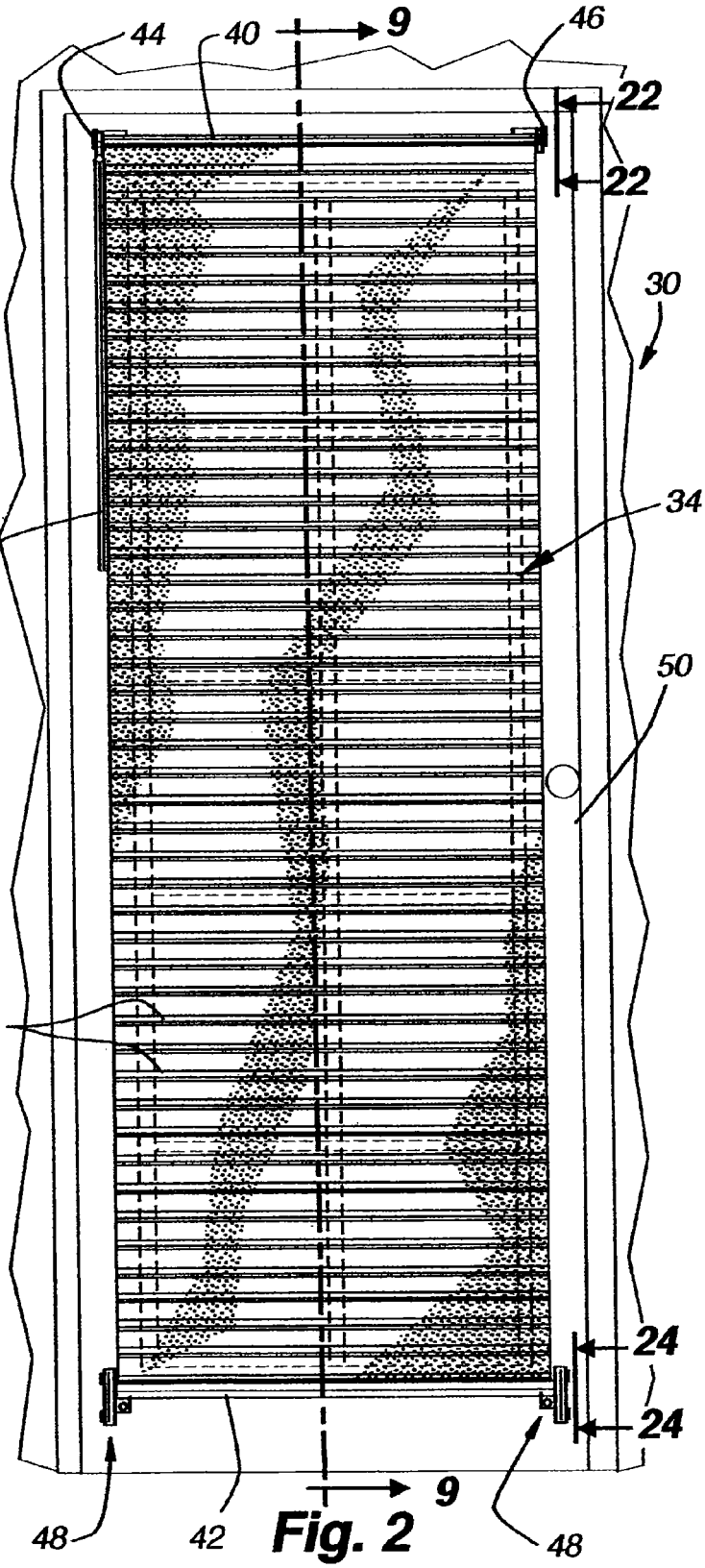
FIG. 2 is a front elevation of the covering as shown in FIG. 1.
Figure 4:
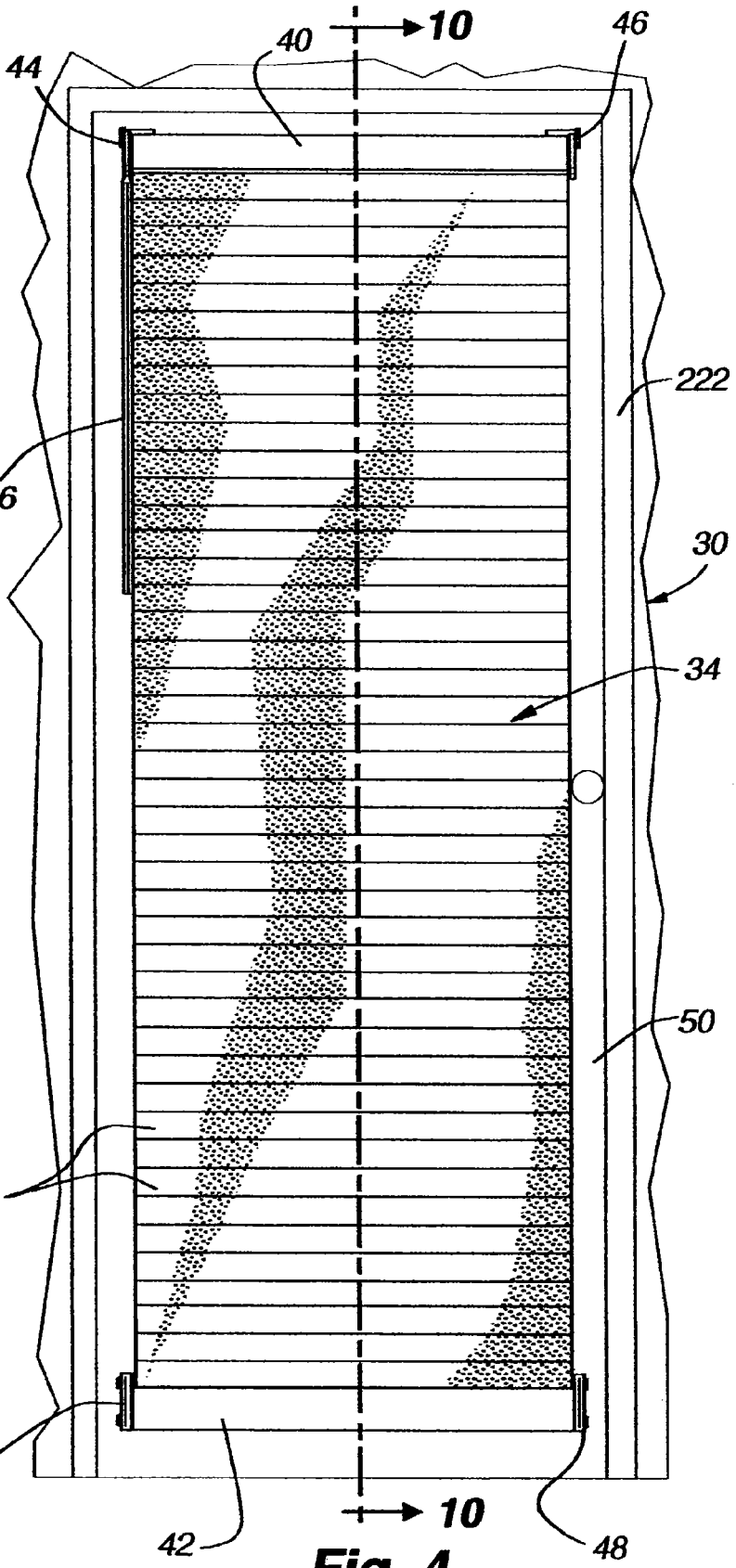
FIG. 4 is a front elevation of the covering of FIG. 1 in a closed condition.

The vanes 38 of the aforedescribed fabric 34 are movable between opened and closed positions by tilting the vanes about horizontal axes with the vanes shown in FIGS. 1-3 in an open position and in FIGS. 4 and 5 in a closed position. In the open position, the vanes are generally horizontally disposed defining spaces therebetween through which vision is permitted. In the closed position, the vanes are generally vertically oriented in an overlapping relationship so there are no spaces therebetween so that the vanes block vision through the fabric. It should be appreciated from the description that follows, however, and as mentioned previously, that the fabric disclosed is not the only fabric material that would be useful in the covering of the present invention, but rather any covering material that included pivotal vanes or slats could be used. The vanes or slats could be supported in spaced relationship either along one edge or both edges. An example of such an alternative product, would be a venetian blind type product wherein the spaced slats conventionally found in venetian blinds are supported by cord ladders which are operatively associated with both the front and rear edges of the slats or only the rear edges as disclosed in U.S. application Ser. No. 10/479,893, filed Dec. 1, 2003, now U.S. Pat. No. 7,168,475, which is of common ownership with the present application and the disclosure of which is hereby incorporated by reference.

It should be appreciated, however, that the fabric 34 illustrated for purposes of the present disclosure, is a cellular fabric having horizontally disposed cells defined between adjacent slats with a cell 52 at the top of the fabric being used for attachment to the active tilt bar 40 and a cell 54 at the bottom of the fabric for attachment to the passive tilt bar 42.

Figures 6, 7:
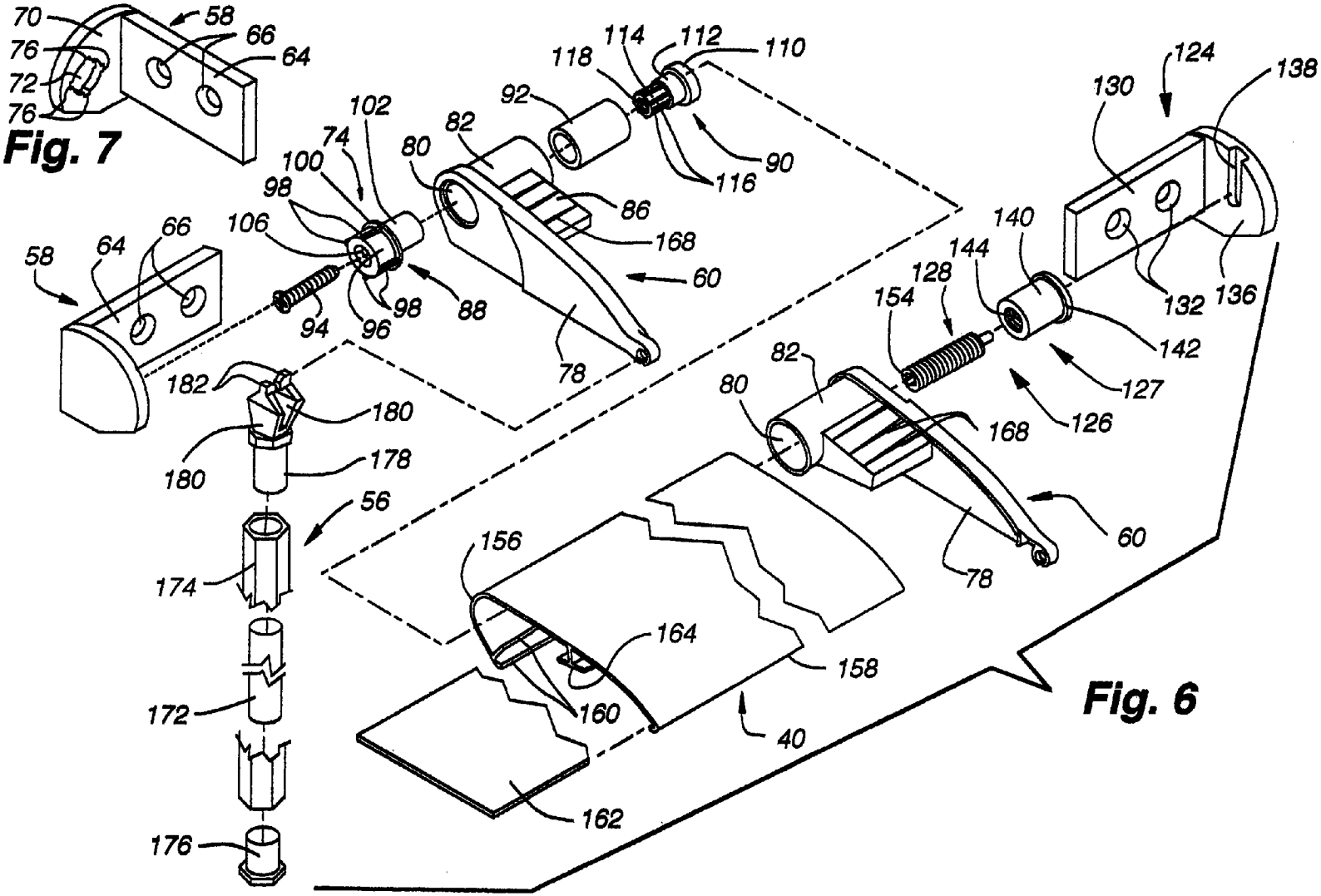
FIG. 6 is an exploded isometric of the active tilt bar and its mounting brackets used in the covering of FIG. 1.
FIG. 7 is an isometric of a mounting bracket used with the active tilt bar as shown in FIG. 6.

The active tilt bar 40 along with its mounting brackets 44 and 46 and a control wand 56 for operating the covering 30 are shown in FIG. 6. The mounting brackets for the active tilt bar are different with one bracket 44 being at the left end of the active tilt bar and the other bracket 46 being at the right end. The mounting bracket 44 at the left end of the active tilt bar can be seen in FIGS. 6 and 7 to include a fixed component 58, a pivotal component 60 and a pivot shaft 74. The fixed component 58 is of generally L shaped configuration having a mounting base 64 with a pair of fastener holes 66 through which screws or other types of fasteners 68 (FIG. 9) can pass to anchor the fixed base to a supporting surface such as the door 50 as illustrated in FIG. 1. A perpendicularly protruding leg 70 from the base has a closed recess 72 therein for receipt of one end of the pivot shaft 74. It will be appreciated the recess opens only inwardly so as to define a seat of generally circular configuration having four rectangular tabs 76 at 90 degree spacings for a purpose to be described hereafter.

The pivotal component 60 of the active mounting bracket 44 at the left end of the active tilt bar has an elongated lever arm 78 with a cylindrical passage 80 through a cylindrical body 82 integrally formed therewith adjacent an inner end. An inner annular shoulder 84 (FIGS. 6, 14 and 15) is formed at the inner end of the cylindrical passage 80 for a purpose to become clear hereafter. Immediately forwardly of the cylindrical body is a rectangular horizontal finger 86 adapted to cooperate with the active tilt 40 bar for connecting the active tilt bar to the pivotal component 60 as will be described hereafter.

Figure 14:
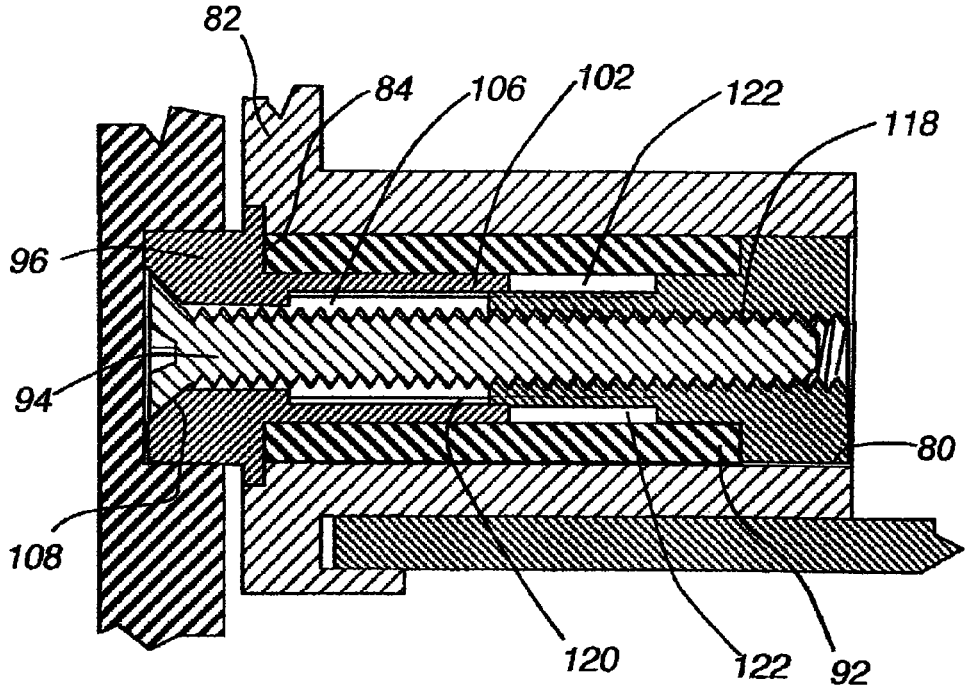
FIG. 14 is a vertical section taken through the pivot shaft for the active tilt bar in a freely pivotal condition.
Figure 15:
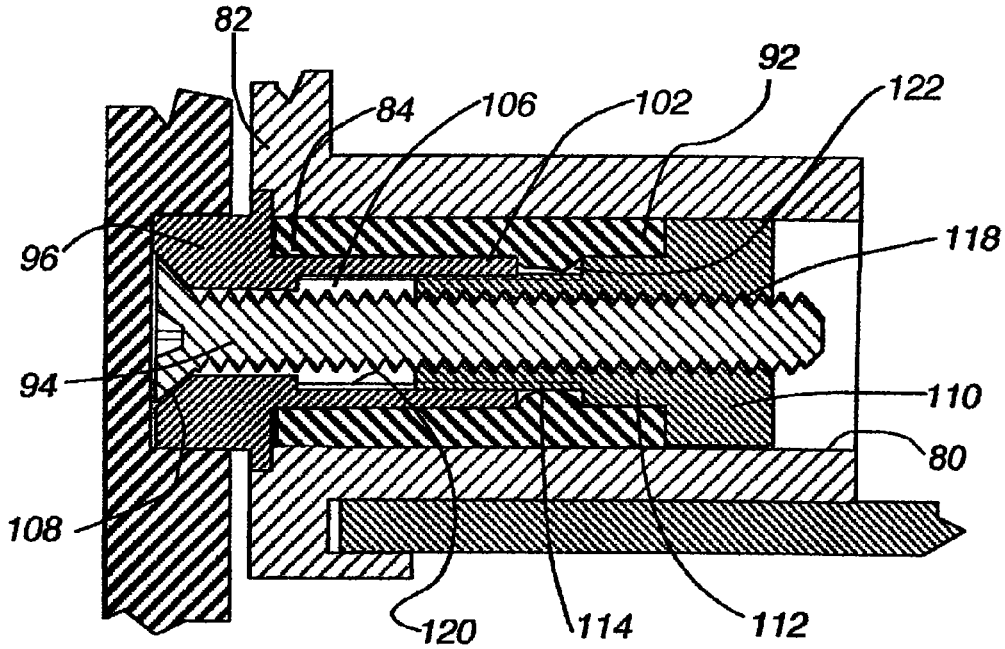
FIG. 15 is a vertical section similar to FIG. 14 with the pivot shaft being tightened relative to its condition of FIG. 14.
Figure 17:
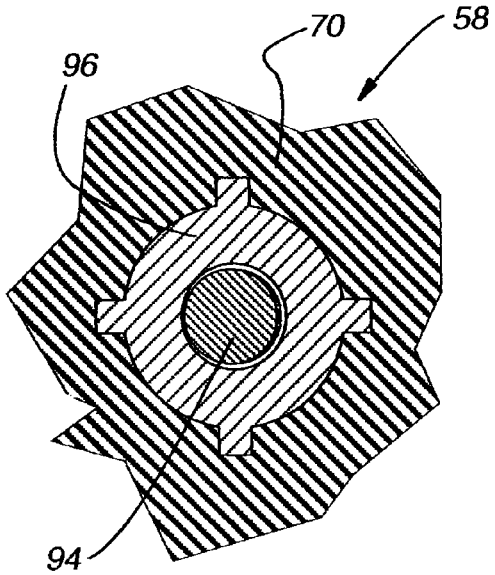
FIG. 17 is an enlarged section taken along line 17-17 of FIG. 13.
Figure 18:
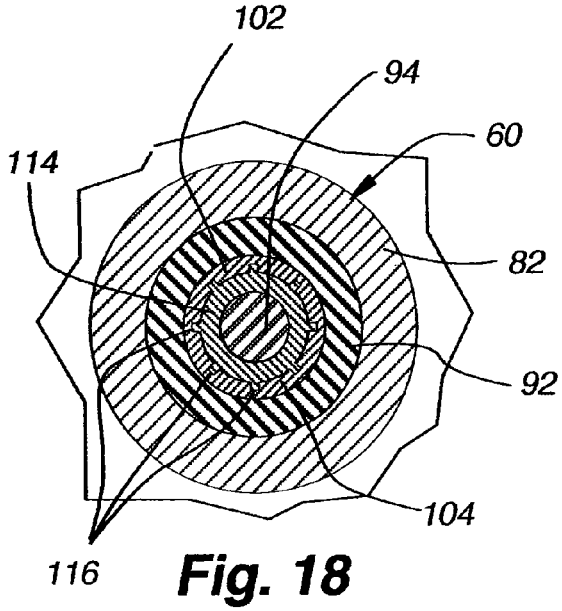
FIG. 18 is an enlarged section taken along line 18-18 of FIG. 13.
Figure 20:
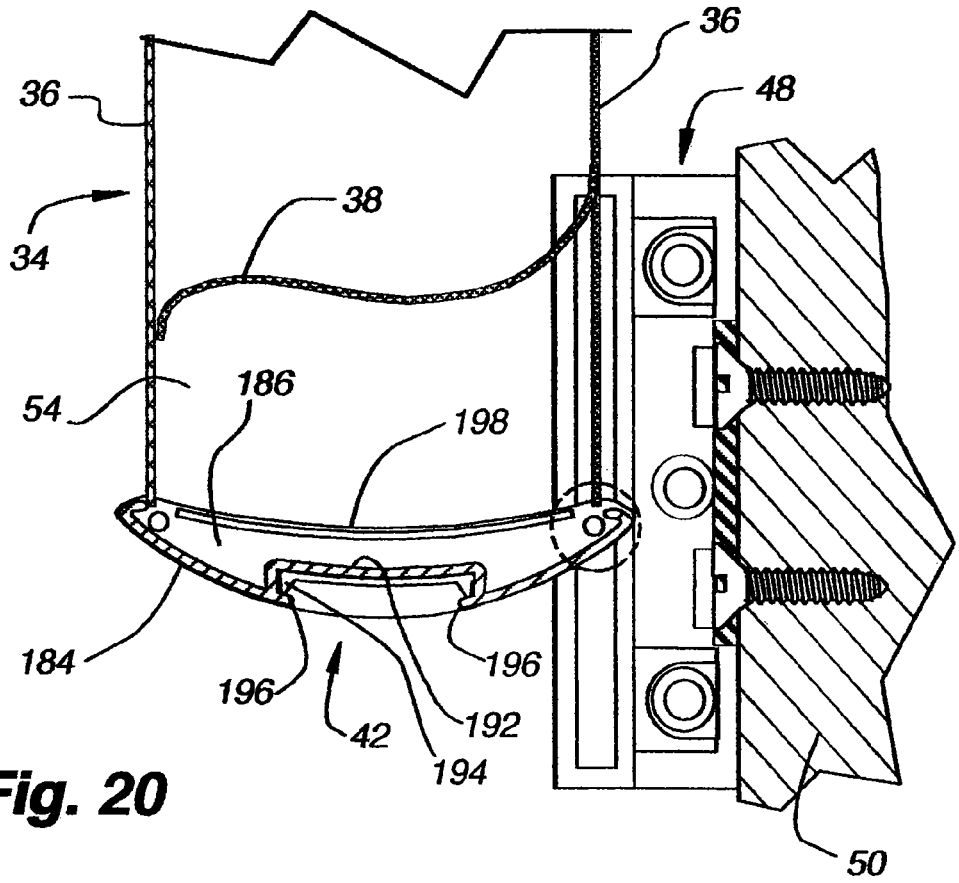
FIG. 20 is a section taken along line 20-20 of FIG. 19.
Figure 21:
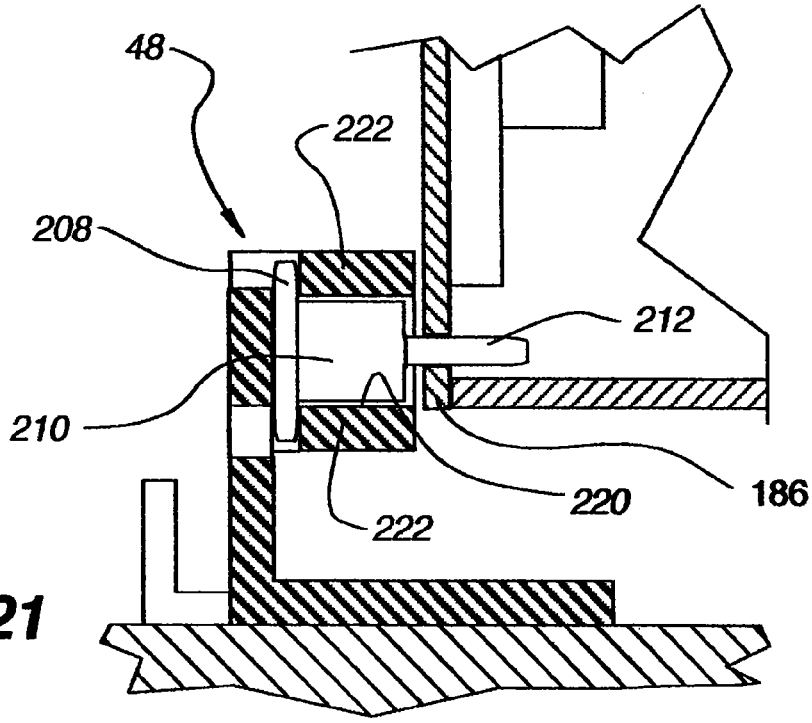
FIG. 21 is a section taken along line 21-21 of FIG. 19.

The pivot shaft 74, probably best seen in FIGS. 6, 14 and 15, interconnects the fixed component 58 of the left mounting bracket 44 with the pivotal component 60. The pivot shaft includes four elements, namely a left coupler 88, a right coupler 90, a resilient radially expandable and contractible cylindrical grommet 92 and a threaded taperhead fastener 94 for interconnecting the left and right couplers in an axially adjustable manner. The left coupler 88 has a cylindrical head 96 with four radially projecting ribs 98 at 90 degree displacement from each other which are alignable with the tabs 76 in the recess 72 of the fixed component of the left mounting bracket. A cylindrical disc 100 integral with the head 96 separates the head from a cylindrical shaft 102 having a plurality of radially inwardly projecting circumferentially spaced splines 104 (FIG. 18). An unthreaded cylindrical passage 106 (FIGS. 14 and 15) extends through the head and the cylindrical shaft 102 with the passage 106 being adapted for slidable receipt of the threaded fastener 94. The exposed end of the head 96 has a beveled seat 108 for receipt of the taperhead of the fastener to prevent the fastener from sliding completely through the passage.

The right coupler 90 (FIGS. 6, 14 and 15) has a cylindrical disc 110 on an outer end integral with a cylindrical body 112 which is in turn integral with a cylindrical shaft 114 that has ribs 116 on its outer surface adapted to cooperate with the splines 104 on the left coupler to prevent relative rotation as will be evident with the description that follows. The right coupler has a threaded passage 118 therethrough for receipt of the fastener 94. The cylindrical shaft 114 on the right coupler has an outer diameter slightly smaller than with the inner diameter of a recess 120 in the inner end of the shaft 102 of the left coupler 88 so that the shaft 114 on the right coupler is slidably insertable into the recess 120 in the shaft of the left coupler. The threaded fastener can extend through both the left and right couplers and by rotating the fastener in one direction or another the components can be pulled axially toward each other or allowed to be separated from each other in a manner described hereinafter as desired.

The resilient grommet 92 is adapted to be seated on the shaft 102 of the left coupler so as to be confined between the left 88 and right 90 couplers and abutted at its left end against the inner annular shoulder 84 of the cylindrical body 82 of the pivotal component 60. Movement of the left and right couplers toward each other with the fastener 94 as shown in FIG. 15 causes the grommet to be axially compressed and radially expanded between the couplers. Of course, movement of the fastener in the opposite direction allows the left and right couplers to axially separate under the influence of the expanding grommet, as shown in FIG. 14. Decompression of the grommet by axial separation of the left and right couplers allows the grommet to return to its rest condition, shown in FIG. 6 by axially extending but radially retracting.

As mentioned previously, the pivotal component 60 has the annular shoulder 84 defined at an inner end of the cylindrical body 82 so that the cylindrical passage 80 through the cylindrical body can receive the elements of the pivot shaft 74, but the left end of the grommet 92 is abutted against the annular shoulder so that the grommet is prevented from being pulled out of the cylindrical passage during axial compression by the fastener 94. This is seen best in FIGS. 14 and 15, with FIG. 14 showing the grommet abutted against the annular shoulder and positioned between the left and right couplers, which are threadedly interconnected by the fastener. In FIG. 15, the fastener has been advanced into the threaded passage 118 of the right coupler to pull the left and right couplers closer together compressing the grommet against the shoulder so that it expands into a space 122 between the left and right couplers and is forced to frictionally grip the left and right couplers as well as the inner cylindrical surface of the cylindrical passage 80. It will be apparent that depending on how far the fastener is advanced into the right coupler determines the amount of axial compression and radial expansion of the grommet and the frictional force that the grommet applies to the inner wall of the cylindrical passage and the left and right couplers. This system functions as an adjustable braking system which regulates the amount of force necessary to pivot the pivotal component 60 of the mounting bracket relative to the fixed component 58 and also helps the fixed and pivotal components to remain in any desired relationship.

Figure 22:
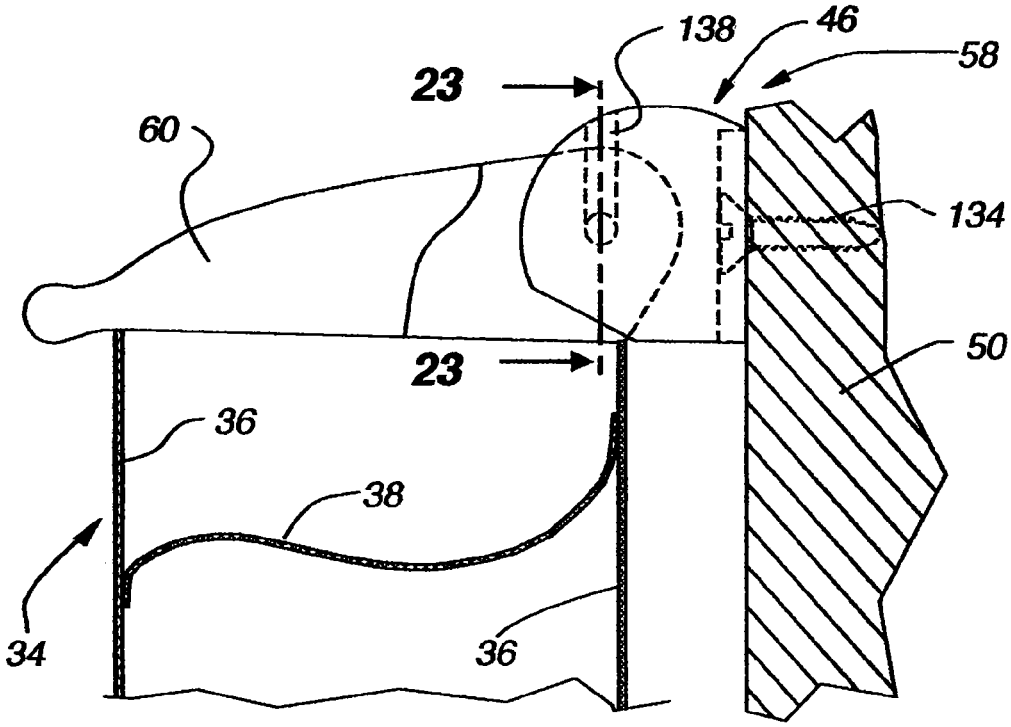
FIG. 22 is an enlarged section taken along line 22-22 of FIG. 2.
Figure 23:
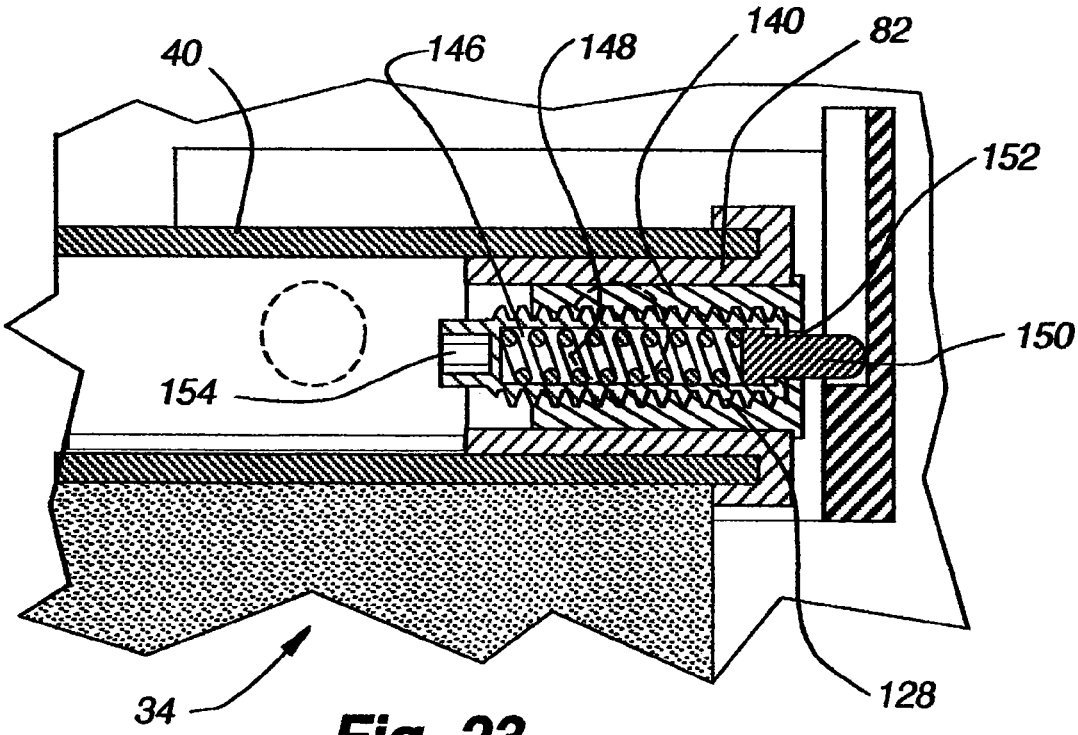
FIG. 23 is an enlarged section taken along line 23-23 of FIG. 22.
Figure 24:
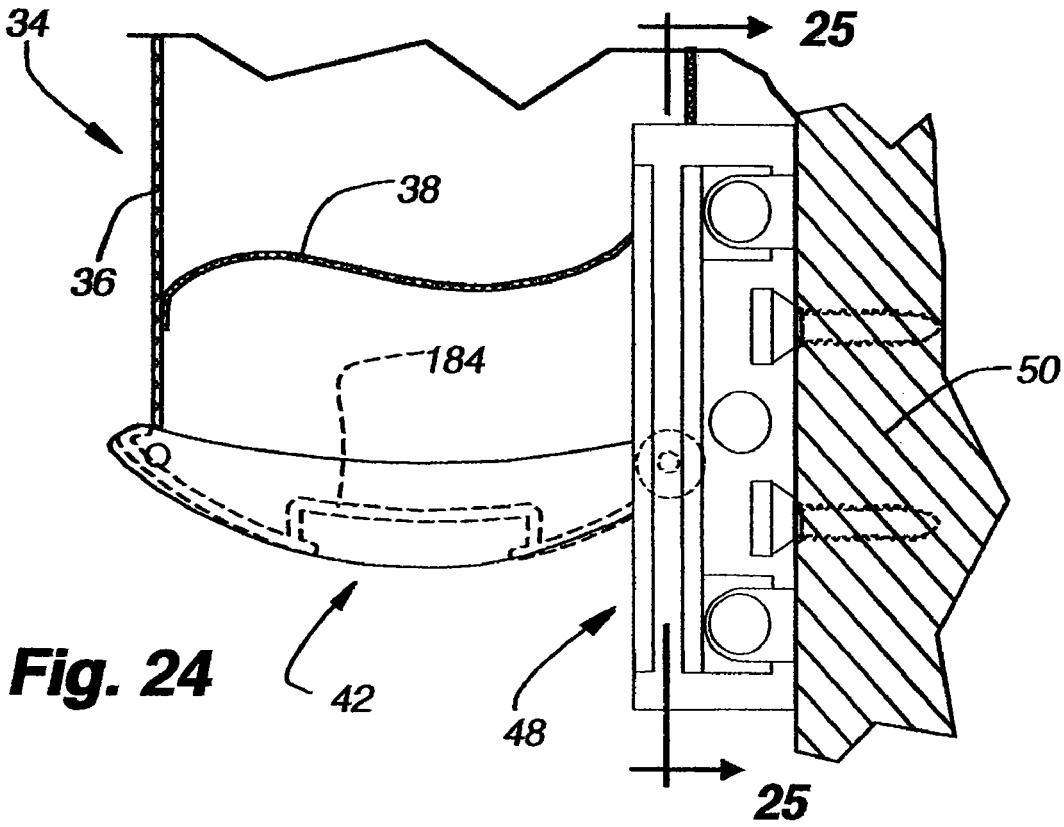
FIG. 24 is an enlarged fragmentary view taken line 24-24 of FIG. 2.
Figure 25:
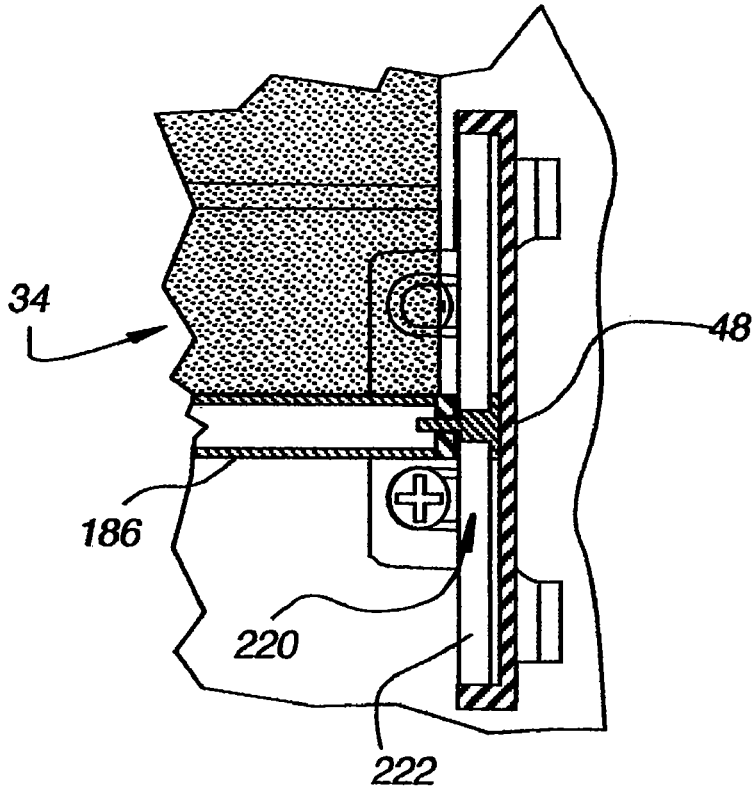
FIG. 25 is a fragmentary section taken along line 25-25 of FIG. 24.

The mounting bracket 46 at the right end of the active tilt bar 40 is also probably seen best in FIG. 6 to include a fixed component 124 and a pivotal component 60 as well as a pivot shaft 126 having a coupler 127 and an externally threaded compression spring element 128. The fixed component 124 of the right mounting bracket has a base 130 with two passages 132 therethrough for receipt of fasteners 134 (FIG. 22) for securing the base to a supporting surface such as the door 50 shown in FIG. 1 and a perpendicular end plate 136 having a vertical groove 38 formed therein which opens through the top of the end plate. The pivot component 60 of the right mounting bracket 46 is identical to the pivot component 60 previously described for the left mounting bracket 44. The coupler 127 has a cylindrical body 140 with an enlarged disc like head 142 on one end and a threaded passage 144 through the coupler. The threaded passage is adapted to threadedly receive the external threads on the compression spring element 128 as seen in FIG. 23.

The compression spring element 128 has an axial cavity 146 (FIG. 23) which receives a coil spring 148 and a guide pin 150. The guide pin projects outwardly through a small opening 152 in the outer end of the compression spring element and is biased outwardly by the coil spring 148 which engages its inner end. The coupler is designed to be spaced from the end plate 136 of the fixed component of the mounting bracket to provide some play between the mounting brackets 44 and 46 and the opposite ends of the active tilt bar 40 as will be apparent hereafter. The inner end of the compression spring element has a socket 154 formed therein for receipt of an allen wrench or other operative tool so that the compression spring element can be threaded into and out of the coupler as desired. It should also be appreciated the guide pin 150 can be slid upwardly in the vertical groove 138 in the end plate to remove the guide pin from its supporting relationship with the end plate thereby freeing one end of the active tilt bar so that it can be removed from its connection with the mounting bracket.

The active tilt bar 40 which is possibly best seen in FIG. 6 is a substantially rigid extrusion having one edge 156 with a relatively large hook shaped configuration and an opposite edge 158 with a very small hook shaped configuration. The large hook shaped edge 156 is adapted to fit over the cylindrical body 82 of the pivot components 60 of the mounting brackets 44 and 46 so that the active tilt bar is supported by the pivotal components at opposite ends. At a terminal edge of the large hook shaped edge 156, a pair of inward protrusions 160 are formed that are aligned with the small hook shaped opposite edge 158 to define a pocket for a retention or anchor strip 162 that is operably inserted through the cell 52 at the top of the fabric 34 for connecting the fabric to the active tilt bar.

Figure 9:
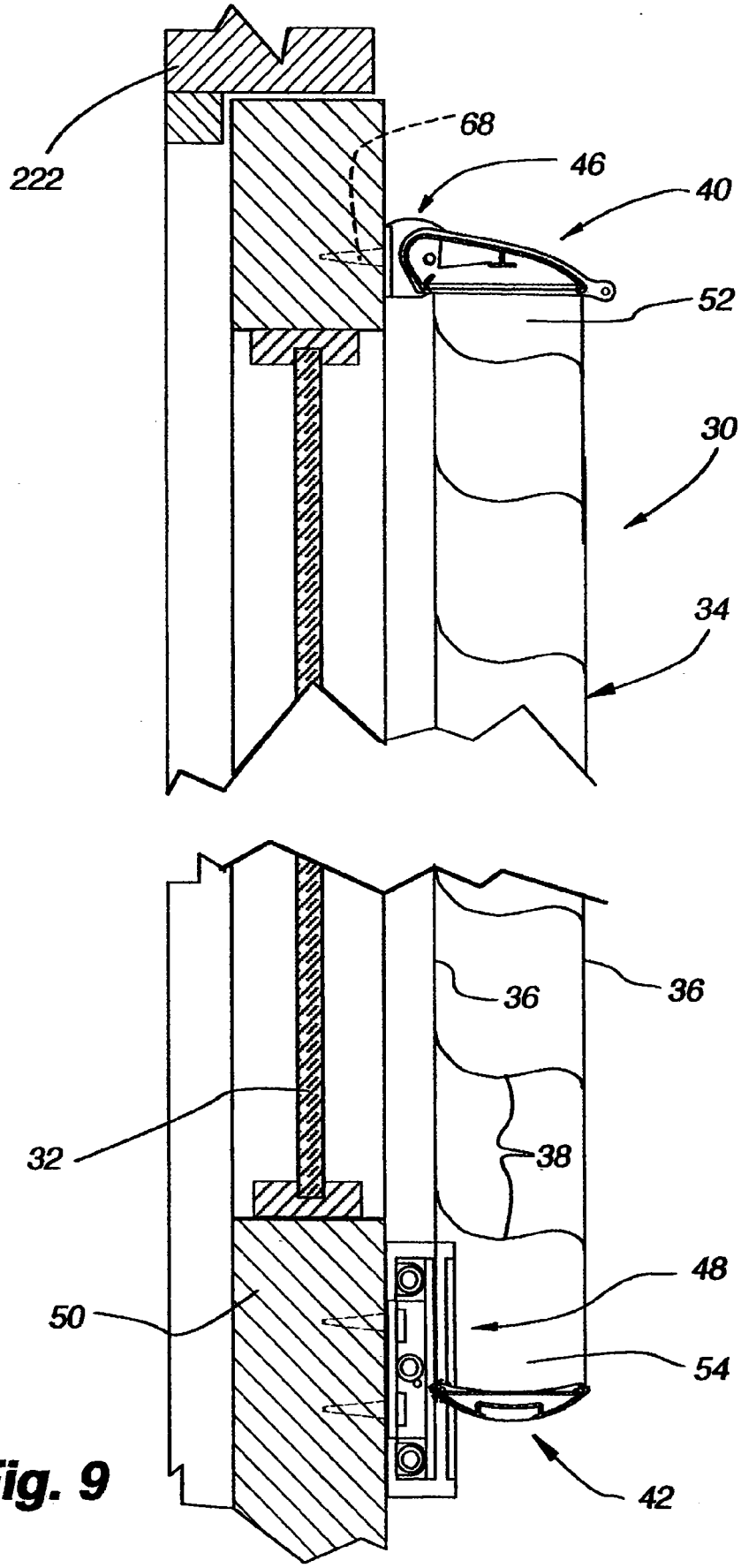
FIG. 9 is an enlarged fragmentary section taken along line 9-9 of FIG. 2.
Figure 12:
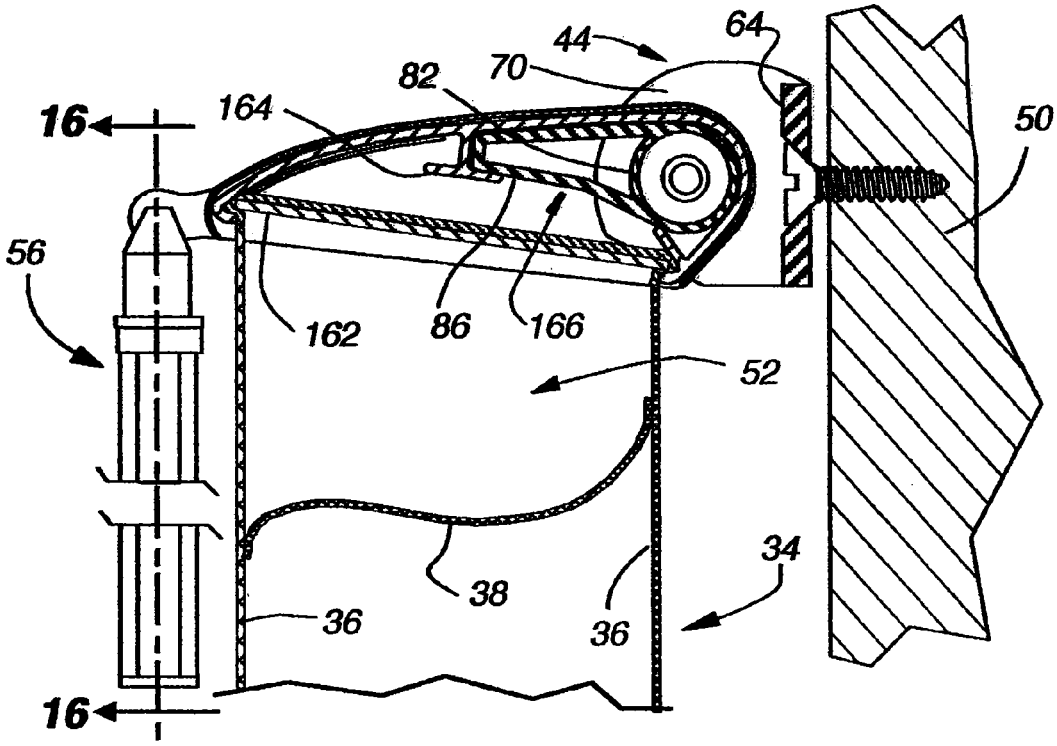
FIG. 12 is a fragmentary section taken along line 12-12 of FIG. 11.
Figure 13:
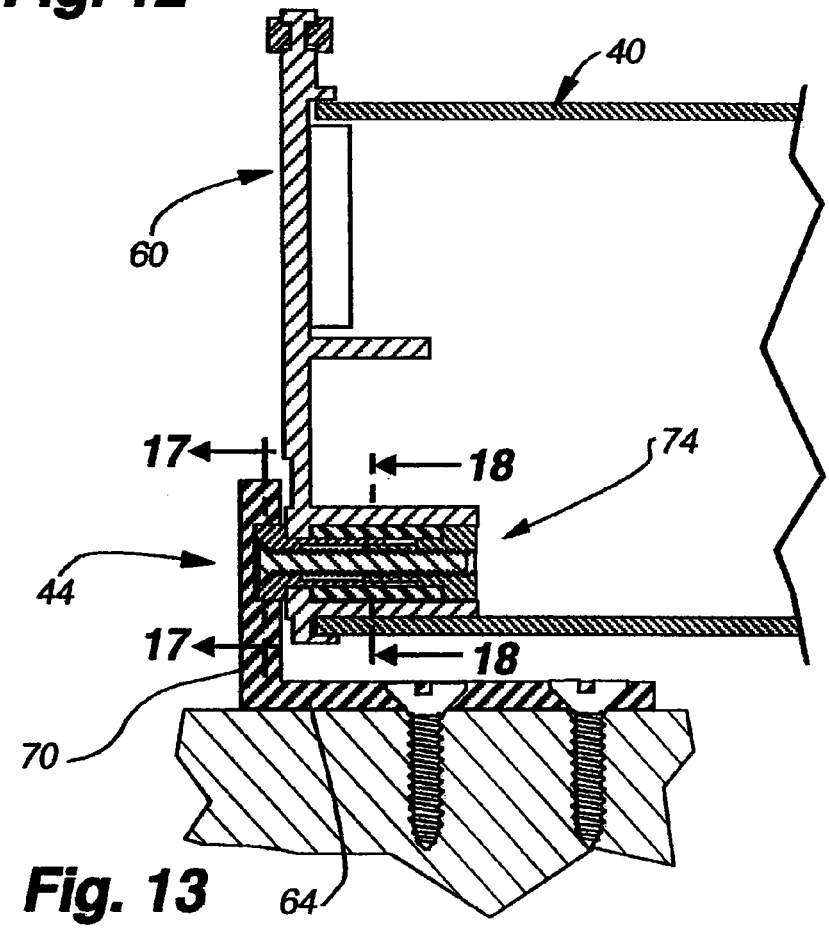
FIG. 13 is an enlarged section taken along line 13-13 of FIG. 11.

The anchor strip 162 extends horizontally through the upper most cell 52 on the fabric as seen best in FIG. 9 and is then inserted into the active tilt bar 40 with the anchor strip being retained between the protrusions 160 and the small hook shaped edge 158 of the active tilt bar. Projecting downwardly from a top wall of the active tilt bar is an inverted T-shaped rib 164 which cooperates with the large hook shaped edge 156 of the active tilt bar in defining a space 166 in which the cylindrical body 82 of the pivotal component 60 and its finger 86 will fit, as possibly seen best in FIG. 12. Ribbing 168 (FIG. 6) on the finger engages the under surface of the top wall of the active tilt bar to frictionally retain the active tilt bar on the pivotal component 60.

It will be appreciated from the above when the active tilt bar 40 is assembled with its left and right mounting brackets 44 and 46 respectively, the pivot shaft 74 at the left end of the active tilt bar is received in the recess 72 of the fixed component of the mounting bracket 44 so it does not rotate while the pivotal component 60 can rotate about the pivot shaft depending upon the radial expansion of the grommet 92 which determines the amount of force necessary to pivot the pivotal component relative to the fixed component 58. Of course, pivotal movement of the pivotal component causes the active tilt bar to move therewith so the movement of the active tilt bar is also dependent upon the braking system employed in the mounting bracket 44 at the left end of the active bar. The right end of the active tilt bar is free to pivot with the pivotal component 60 associated therewith about the guide pin 150 which is pivotally and slidably received in the groove 138 of the fixed component 124 of the mounting bracket. As mentioned previously, to remove the active tilt bar from the left and right mounting brackets, it is simply necessary to slide the enlarged head 96 of the left coupler 88 at the left end of the active tilt bar out of the closed recess 72 in the base 64 which is permitted by the coil spring 148 at the right end of the active tilt bar and then simply lifting the entire active tilt bar off the base components of the mounting brackets by sliding the guide pin out of the open top of the groove in the associated fixed component. Of course, the reverse is true for mounting the active tilt bar in the mounting brackets.

Figure 16:
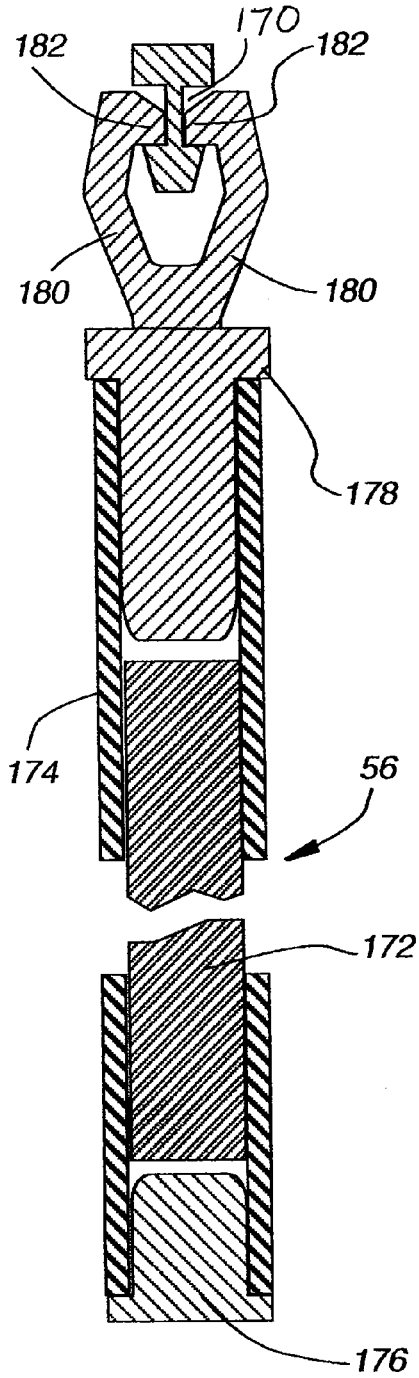
FIG. 16 is an enlarged fragmentary vertical section taken along line 16-16 of FIG. 12.

It should also be appreciated the control wand 56, as probably best seen in FIG. 16, which can be made of rigid or semi-rigid material such as plastic or rubber and can be attached to the free or distal end of either of the pivotal components 60 of the mounting brackets 44 and 46 with each pivotal component having a transverse seat 170 (FIG. 16) therethrough at a distal end thereof. The control wand is illustrated as having a cylindrical body 172 with an outer skin 174 of a hexagonal decorative body with an end cap 176 at the lower end and an end cap 178 at the upper end. The end cap at the upper end has a pair of spaced upwardly directed arms 180 with inwardly directed confronting pins 182 at their uppermost ends with the pins being adapted to snap into the seat 170 through the distal end of the desired pivotal component 60. The end cap at the top of the control wand is made of a semi-rigid material which permits the pins to be separated enough to snap into the hole, but rigid enough to retain it therein during normal operation. The control wand can then be gripped by an operator and raised or lowered to pivotally move the active tilt bar.

Figure 8:
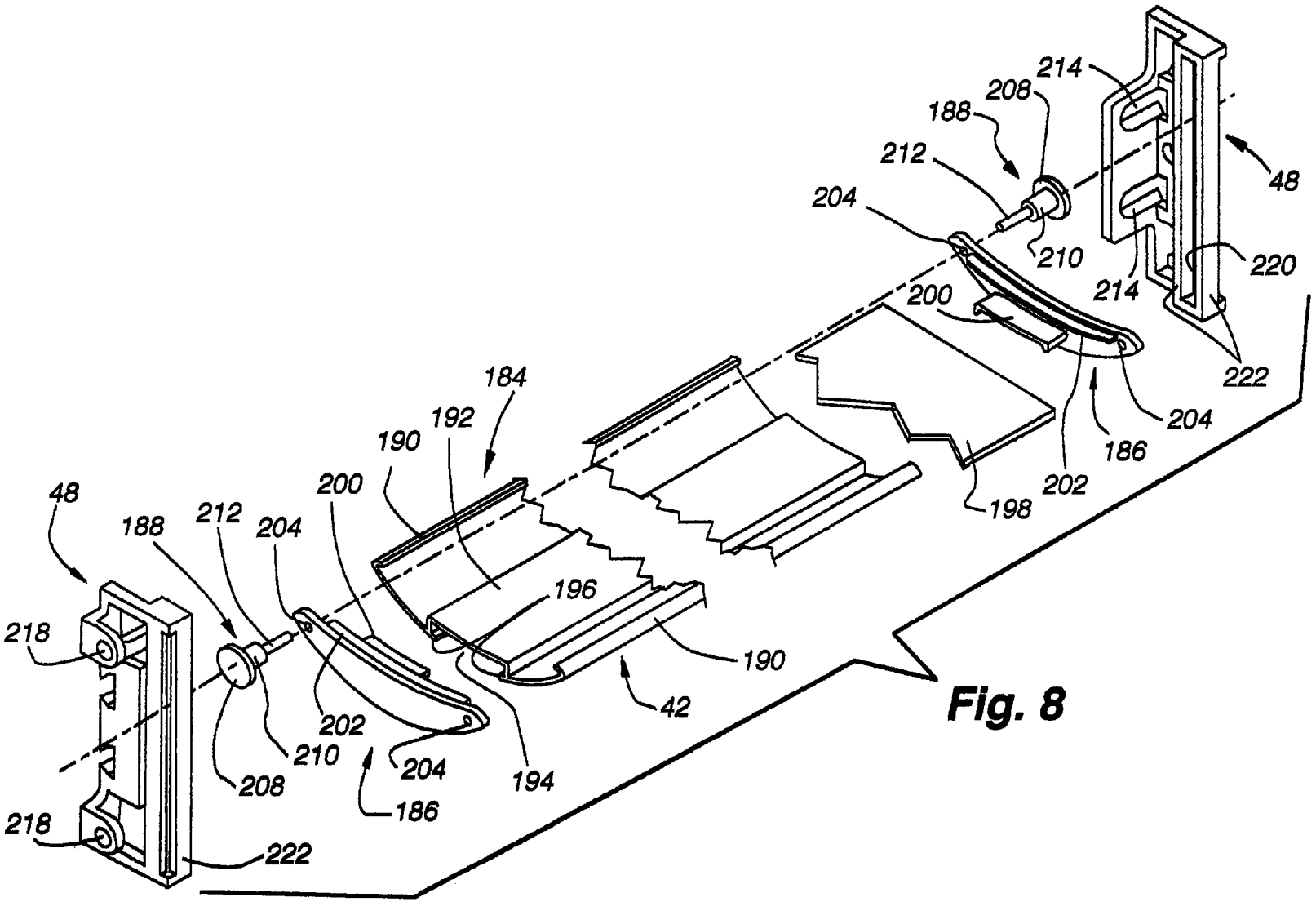
FIG. 8 is an exploded isometric of the passive tilt bar and its mounting brackets used in the covering of FIG. 1.

The passive tilt bar 42 which for purposes of the present disclosure is shown mounted at the bottom of the covering 30 could be interchanged with the active tilt bar 40. The passive tilt bar is shown best in FIGS. 8, 19, 20, 21, 24 and 25. With initial reference to FIG. 8, it will be seen the passive tilt bar includes an extrusion 184 having crescent configured end caps 186 and guide pins 188 releasably connectable to the end caps that are confined for vertical sliding movement in the identical mounting brackets 48 at opposite ends of the passive tilt bar. The extrusion 184 can be seen in FIG. 8 to be a generally arched plate like body having inturned lips 190 along opposite longitudinal edges and an upstanding hollow rib 192 along its longitudinal center defining a downwardly opening slot 194 with a pair of confinement lips 196. The inturned lips along opposite edges of the extrusion are designed to confine an anchor strip 198 of a rigid or semi-rigid material that is disposed within the cell 54 at the bottom of the fabric material 34 and positioned between the lips 194 to anchor the lower edge of the fabric material to the passive tilt bar.

The end caps 186 have crescent shaped plate like main bodies with a downturned protrusion 200 of a size and configuration to be inserted into the downwardly opening slot 194 of the extrusion so as to be frictionally retained therein. An overhanging arched rib 202 extends adjacent to the top edge of the crescent shaped body to overly and confine the ends of the anchor strip 198 so that the anchor strip is positively confined within the extrusion. The plate like portions of the end caps have holes 204 at opposite ends to releasably receive a guide pin 188 slidably supported by a mounting bracket 48. The guide pin, as shown best in FIG. 21, has an enlarged disc like head 208, an intermediate cylindrical body 210 and a cylindrical projection 212 therefrom with the cylindrical projection being of a size to slidably fit within a selected one of the holes 204 in the end cap 186.

The mounting brackets 48 are identical and are of generally block like construction defining a pair of slots 214 for receipt of fasteners 216 (FIG. 10) for securing the brackets to the support structure which in the disclosed embodiment is the door 50 as shown in FIG. 1 or an alternative pair of holes 218 which are perpendicularly oriented relative thereto so that the brackets could be mounted on a different surface of the support structure depending upon the location desired for mounting the passive tilt bar 42. Each bracket also has an inwardly opening slot 220 (FIGS. 8, 21 and 25) defined between a pair of spaced guide rails 222 with the slot being of a size for slidable receipt of the intermediate body 210 of the guide pin 188 and so that the enlarged head 208 of the guide pin can be retained behind the guide bars. The brackets are made of a somewhat rigid material, but a material such as plastic that is flexible enough to allow the head of the pin to be snapped between the guide bars to confine the pin for sliding movement along the vertical extent of the slot 220 in the bracket.

It will therefore be appreciated that the extrusion 184 with the end caps 186 mounted thereon is free to pivot about the associated guide pins 188 and can also move or slide vertically with the guide pins along the slots 220 in the brackets 48.

Figure 10:
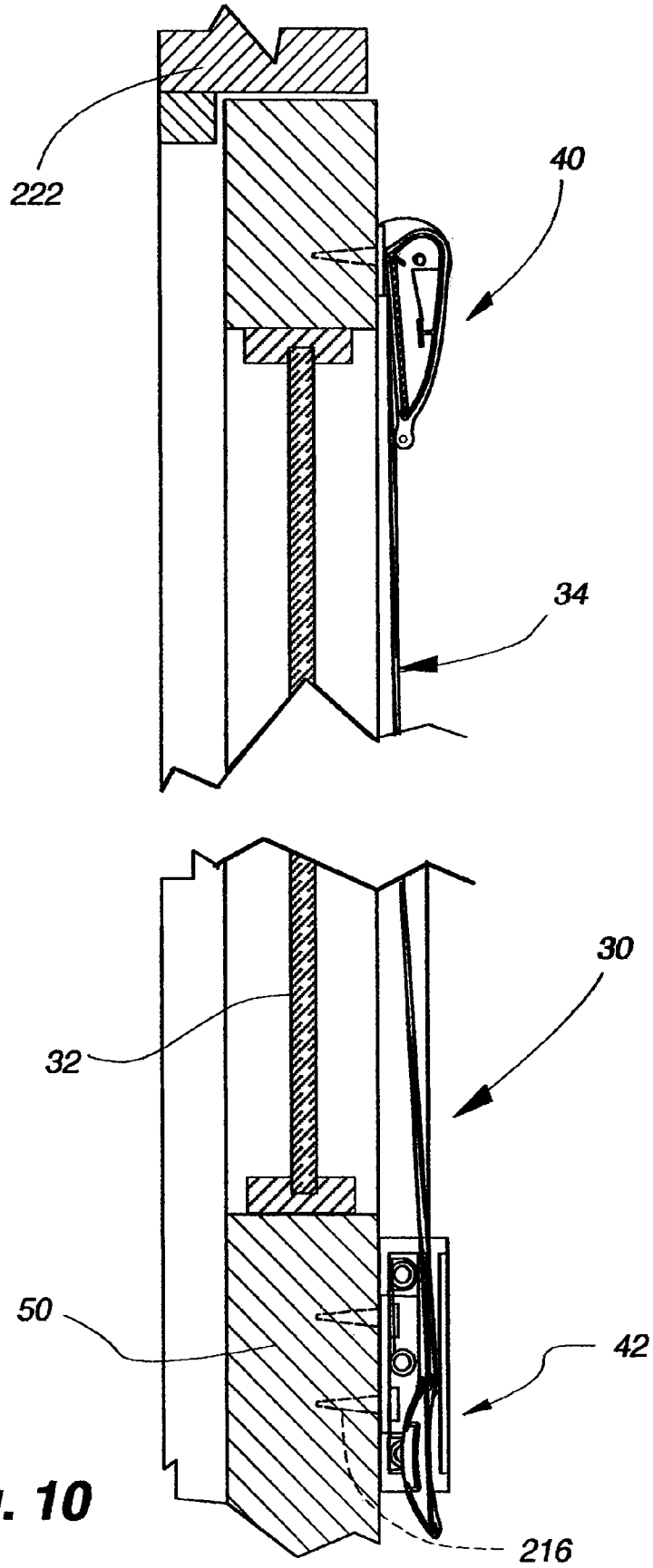
FIG. 10 is an enlarged fragmentary section taken along line 10-10 of FIG. 4.
Figure 11:
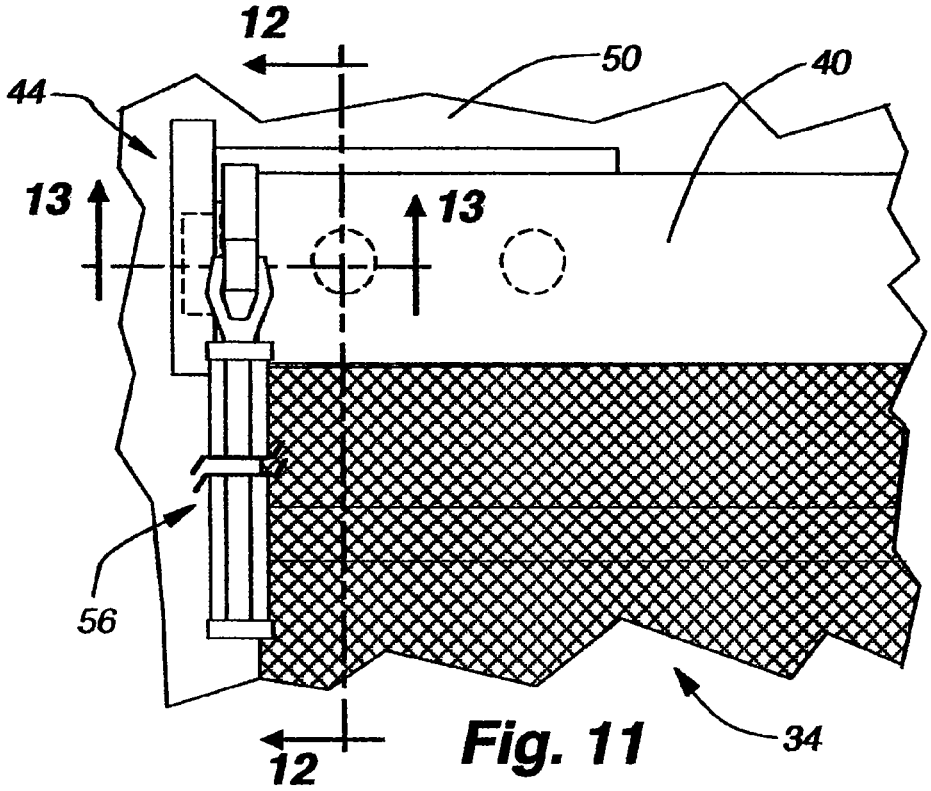
FIG. 11 is an enlarged fragmentary view taken along line 11-11 of FIG. 3.
Figure 19:
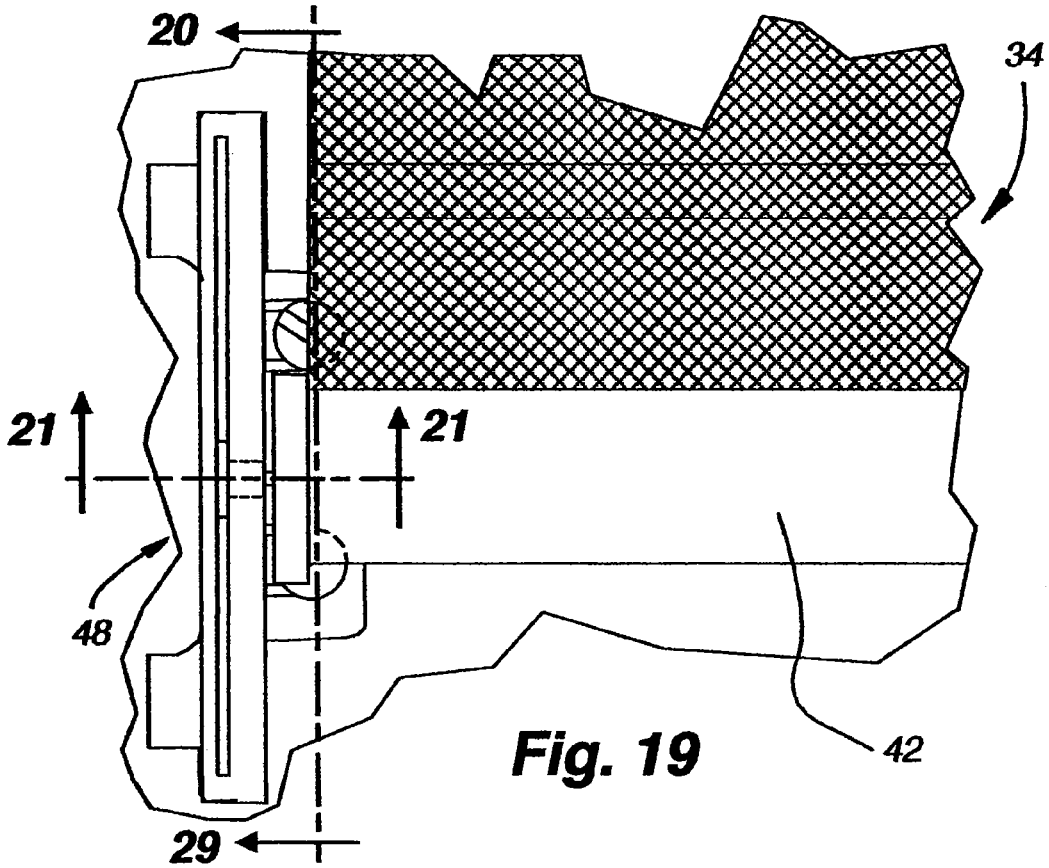
FIG. 19 is an enlarged view taken along line 19-19 of FIG. 3.

With reference to FIGS. 9 and 10, the covering 30 of the present invention can be seen mounted on the door 50 which supports the panel of glass 32 for example and the door is mounted within a door jam 222 of a building structure. In FIG. 9, the covering is shown in an open position with the pivotal components 60 of the upper mounting brackets 44 and 46 having been pivoted so as to extend perpendicularly away from the door thereby holding the sheets 36 of sheer material in spaced relationship and with the flexible vanes 38 extending substantially horizontally therebetween so that spaces are defined between the vanes through which vision can pass. The front and rear sheets 36 of sheer material are of an identical length so that when the fabric is supported at its top end with the anchor strip 162 of the active tilt bar 40 and at the lower end with the anchor strip 198 of the passive tilt bar 42, the passive tilt bar will also extend perpendicularly away from the door in parallel relationship with the active tilt bar 40. When the active tilt bar is pivoted downwardly as shown in FIG. 10 into substantially parallel relationship with the door, the front and rear sheets 36 of sheer material are moved relative to each other in opposite directions causing the vanes 38 to pivot about longitudinal axes thereof into a vertical plane of overlapping vanes as seen in FIGS. 4 and 5. The passive tilt bar follows the active tilt bar so that it to lies in parallel relationship with the door. While the tilt wand 56 is not shown in FIGS. 9 and 10, it will be appreciated its connection to the pivotal component of the active tilt bar (which is optional) is utilized to move the covering between the open position of FIG. 9 and the closed position of FIG. 10.

Although the present invention has been described with a certain degree of particularly, it is understood the disclosure has been made by way of example, and changes in detail or structure may be made without departing from the spirit of the invention as defined in the appended claims.

What is claimed is:

1. A nonretractable covering for an architectural opening comprising in combination:

a fabric defined by a plurality of elongated horizontally disposed vertically spaced vanes having front and rear edges and a support structure including a front and/or rear vertically oriented support element secured to said front and/or rear edges respectively such that movement of said front and/or rear elements in a vertical plane causes said vanes to pivot about horizontal axes between an open position wherein said vanes are substantially horizontally oriented defining spaces therebetween and a closed position wherein said vanes are vertically oriented substantially in a vertical plane, said fabric having upper and lower edges, a horizontally disposed active tilt bar secured to one of said upper or lower edges of said fabric mounted for pivotal movement about a horizontal axis to simultaneously move said front and/or rear elements in a vertical plane, and a passive horizontally disposed tilt bar secured to the other of said upper and lower edges of said fabric and mounted for pivotal movement about a horizontal axis in response to pivotal movement of said active tilt bar.

mounting brackets for pivotally supporting said active tilt bar and wherein at least one of said mounting brackets includes a variably resistant braking system to vary the amount of force necessary to pivot said active tilt bar, said braking system including a pivotal component securable to said active tilt bar such that pivotal movement of said pivotal component affects pivotal movement of said active tilt bar, a pivot shaft securable to said pivotal component such that said pivotal component pivots about said pivot shaft, said pivotal component including a cylindrical passage and said pivot shaft including two confronting shaft components received in opposite ends of said cylindrical passage and a system for selectively moving said shaft components toward and away from each other, a resilient cylindrical component positioned within said cylindrical passage and between said shaft components, said resilient component being compressible axially to effect radial expansion against the wall of said cylindrical passage, said resilient component further being radially contractible upon release of said axial compression, and said resilient component frictionally engaging said wall when radially expanded to resist pivotal movement.

2. The covering of claim 1 wherein there are front and rear support elements which move in opposite directions in a vertical plane.

3. The covering of claim 1 further including second mounting brackets supporting said passive tilt bar for free pivotal movement about its horizontal axis.

4. The covering of claim 3 wherein said second mounting brackets include a slide for permitting vertical linear movement of said passive tilt bar.

5. The covering of claim 2 wherein said active tilt bar is secured to said upper edge of said fabric and said passive tilt bar is secured to said lower edge of said fabric.

6. The covering of claim 2 further including a control element wherein said control element is a rigid wand connected to said pivotal component of said first mentioned mounting bracket.

7. The covering of claim 2 wherein said support elements are sheer and said vanes are made of a flexible opaque or flexible translucent material.

* * * * *